United States Patent [19]

Meier

[11] Patent Number: 4,561,369

[45] Date of Patent: Dec. 31, 1985

[54] SEWN PATTERN ARRANGEMENT TO BE PRODUCED BY A ZIG ZAG SEWING MACHINE

[75] Inventor: Günter Meier, Karlsruhe-Durlach, Fed. Rep. of Germany

[73] Assignee: Dorina Nähmaschinen GmbH, Fed. Rep. of Germany

[21] Appl. No.: 532,830

[22] Filed: Sep. 16, 1983

[30] Foreign Application Priority Data

Sep. 21, 1982 [DE] Fed. Rep. of Germany ..... 3234864

[51] Int. Cl.[4] ..... D05C 17/00; D05B 3/02

[52] U.S. Cl. ..... 112/266.1; 112/439; 112/454

[58] Field of Search ..... 112/158 E, 439, 266.1, 112/262.3, 121.12, 102, 103, 78, 98, 454, 453

[56] References Cited

U.S. PATENT DOCUMENTS 4,223,616 9/1980 Kunimatsu et al. ..... 112/158 E
4,266,493 5/1981 Hanyu et al. ..... 112/158 E
4,299,180 11/1981 Kume et al. ..... 112/158 E
4,372,232 2/1983 Dunn et al. ..... 112/158 E
4,409,915 10/1983 Eguchi et al. ..... 112/158 E X
4,466,370 8/1984 Eguchi et al. ..... 112/441

*Primary Examiner*—Peter Nerbun
*Attorney, Agent, or Firm*—McGlew and Tuttle

[57] ABSTRACT

A sewn pattern arrangement is produced by a zig zag sewing machine in a workpiece, within the range of a modular pattern length and width. Individual elementary patterns are sewn which are formed by several stitches and are preferably of the cross-stitch type and extend each only over a fraction of the modular pattern width. This makes it possible to sew elementary patterns at various locations within the provided range of widths, so that a variety of optically impressive designs may be produced by sewing pattern rows in a desired configuration. The respective final stitch of a pattern element forms the first stitch of the subsequent one, so that jump stitches between elementary patterns are avoided. Large-area patterns may be obtained by grouping rows of pattern elements side by side.

13 Claims, 18 Drawing Figures

| Penetration Point | Position of Feed | Position of Needle |
|---|---|---|
| 0 | T 0 | B 18 |
| 1 | T +13 | B 19 |
| 2 | T - 1 | B 6 |
| 3 | T 0 | B 18 |
| 4 | T 0 | B 30 |
| 5 | T - 1 | B 17 |
| 6 | T +13 | B 18 |
| 7 | T - 12 | B 18 |
| 8 | T - 12 | B 18 |
| 9 | T + 24 | B 18 |

| Penetration Point | Position of Feed | Position of Needle |
|---|---|---|
| 0 | T 0 | B 18 |
| 1 | T +18 | B 0 |
| 2 | T -18 | B 18 |
| 3 | T +9 | B 8 |
| 4 | T +9 | B 18 |
| 5 | T -18 | B 0 |
| 6 | T +18 | B 18 |
| | | |
| 0 | T 0 | B 18 |
| 1 | T+18 | B 36 |
| 2 | T-18 | B 18 |
| 3 | T+ 9 | B 28 |
| 4 | T + 9 | B 18 |
| 5 | T-18 | B 36 |
| 6 | T+18 | B 18 |

| Penetration Point | Position of Feed | Position of Needle |
|---|---|---|
| 0 | T 0 | B 18 |
| 1 | T +18 | B 0 |
| 2 | T -18 | B 18 |
| 3 | T +9 | B 8 |
| 4 | T +9 | B 18 |
| 5 | T -18 | B 0 |
| 6 | T+18 | B 18 |
| 7 | T -10 | B 27 |
| 8 | T +10 | B 36 |
| 9 | T-18 | B 18 |
| 10 | T+10 | B 27 |
| 11 | T-10 | B 36 |
| 12 | T+18 | B 18 |

Fig. 14
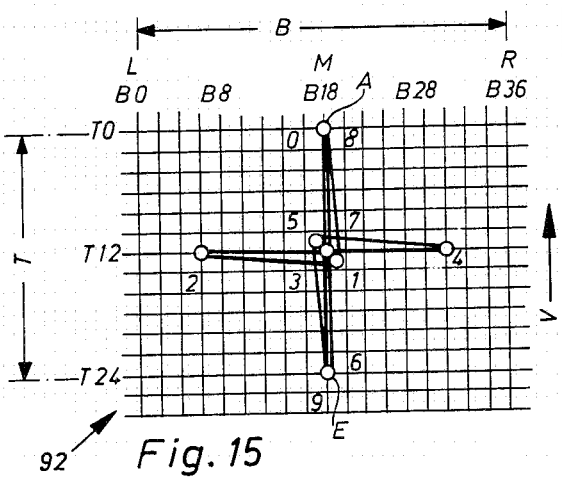
Fig. 15
| Penetration Point | Position of Feed | Position of Needle |
|---|---|---|
| 0 | T 0 | B 18 |
| 1 | T +13 | B 19 |
| 2 | T - 1 | B 6 |
| 3 | T 0 | B 18 |
| 4 | T 0 | B 30 |
| 5 | T - 1 | B 17 |
| 6 | T +13 | B 18 |
| 7 | T - 12 | B 18 |
| 8 | T - 12 | B 18 |
| 9 | T + 24 | B 18 |
Fig. 16
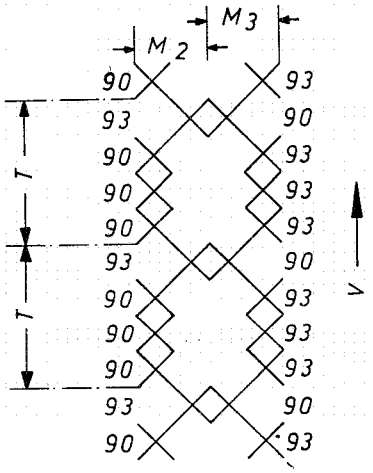
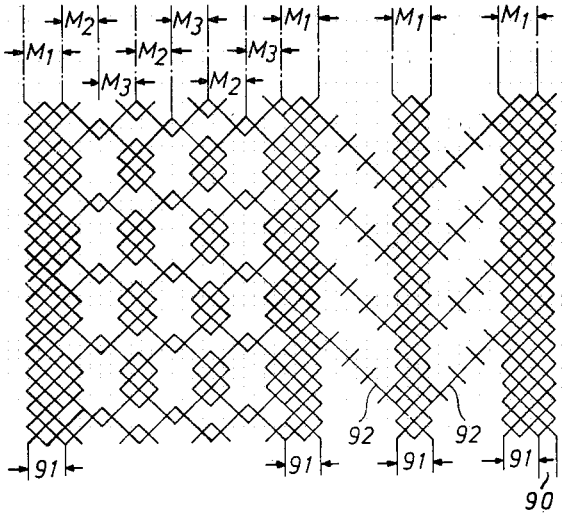
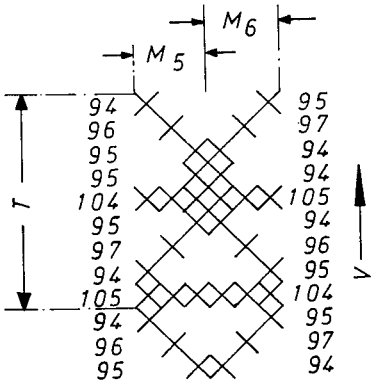
Fig. 17
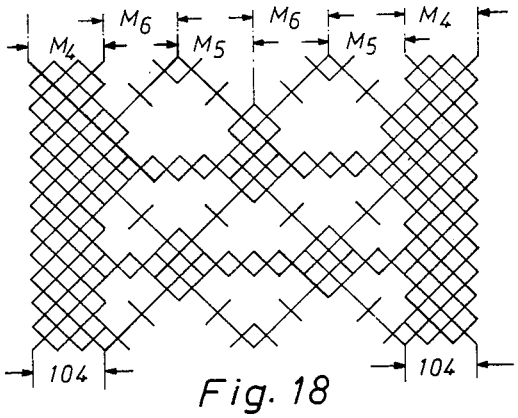
Fig. 18

SEWN PATTERN ARRANGEMENT TO BE PRODUCED BY A ZIG ZAG SEWING MACHINE

FIELD AND BACKGROUND OF THE INVENTION

This invention relates in general to sewing machines and their operation and in particular to a new and useful sewn pattern and method of making such a pattern.

The possibilities of combining pattern rows formed of consecutive individual patterns to optically effective extended patterns, such as borders or ornmental edgings, by shifting the work at the end of one row transversely to the feed direction through at least one needle stitch width or bight are limited, because of the small number of pattern rows available for the variation, and since the respective subsequent pattern cannot be set to the preceding one in any direction without causing jump stitches. Jump stitches are connecting stitches which do not form any part of either of the adjacent patterns.

SUMMARY OF THE INVENTION

The invention is directed to an arrangement of sewn patterns permitting continuation within the bight zone of the zig zag sewing machine in a selected direction to a greatly variable pattern row, without producing jump stitches.

In accordance with the invention the sewn pattern arrangement has a pattern length and a pattern width and the pattern is produced by a zig zag sewing machine. The workpiece is positioned in the range of a pattern length and within the stitch width of a zig zag sewing machine and individual patterns are sewn which comprise a plurality of stitches having a width equal to a fraction of the stitch width and include a final perforation which is within the range of the pattern length which forms the starting perforation of a subsequent pattern in the next range of pattern length.

In accordance with the method of the invention the patterns are effected by controlling the swing of the needle which determines the stitch width regulating the feed of the workpiece backwardly and forwardly by stepping motors so as to form a plurality of stitches in the pattern which have the width of the stitch width and which include a perforation made in the range of the pattern length to form a starting perforation of the subsequent pattern.

With the invention, the individual pattern elements can be distributed in the work over the bight zone of any zig zag sewing machine and combined to pattern rows in various configurations without making jump stitches at either side of the work, so that by juxtaposing a plurality of pattern rows in parallel, the greatest variety of border patterns can be produced. The opportunity is thus given to make patterns in combinations as required or desired, which were hitherto obtainable only by tedious handwork.

In one arrangement of the invention at least the diagonal line extending from the last perforation by the needle to the final perforation of a cross stitch pattern is covered by a continuous length of thread. The final perforation E of each of the patterns may be offset relative to the starting perforation A thereof in a direction parallel to the feed direction. Complete elementary patterns may be provided in this manner in adjoining positions in the feed or opposite direction and at varying locations within the bight range. A great variety of patterns can thus be sewed with machines having larger bight ranges.

Accordingly it is an object of the invention to provide an improved stitch pattern in which the pattern is formed within the stitch width area and the perforation is made in the range of the pattern length to form a starting perforation for the subsequent pattern.

A further object of the invention is to provide a method of effecting a pattern formation to include a perforation from one pattern arrangement to a next adjacent pattern.

A further object of the invention is to provide a sewn pattern which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the Drawings:

FIGS. 12–14 illustrate the sequence of stitches to be made while producing elementary pattern examples shown in FIGS. 2–4, and include tables of respective positions programmed for the stepping motors;

FIG. 15 illustrates how two pattern rows in adjoining position are produced;

FIG. 16 is a view, about in actual size, of a border pattern combined of several pattern rows;

FIG. 17 is a view similar to FIG. 15 showing how another combination of two pattern rows is made, and;

FIG. 18 is a view similar to FIG. 16, about twice the actual size, showing another border pattern combined of several pattern rows.

GENERAL DESCRIPTION OF PREFERRED EMBODIMENTS

Figure 1:
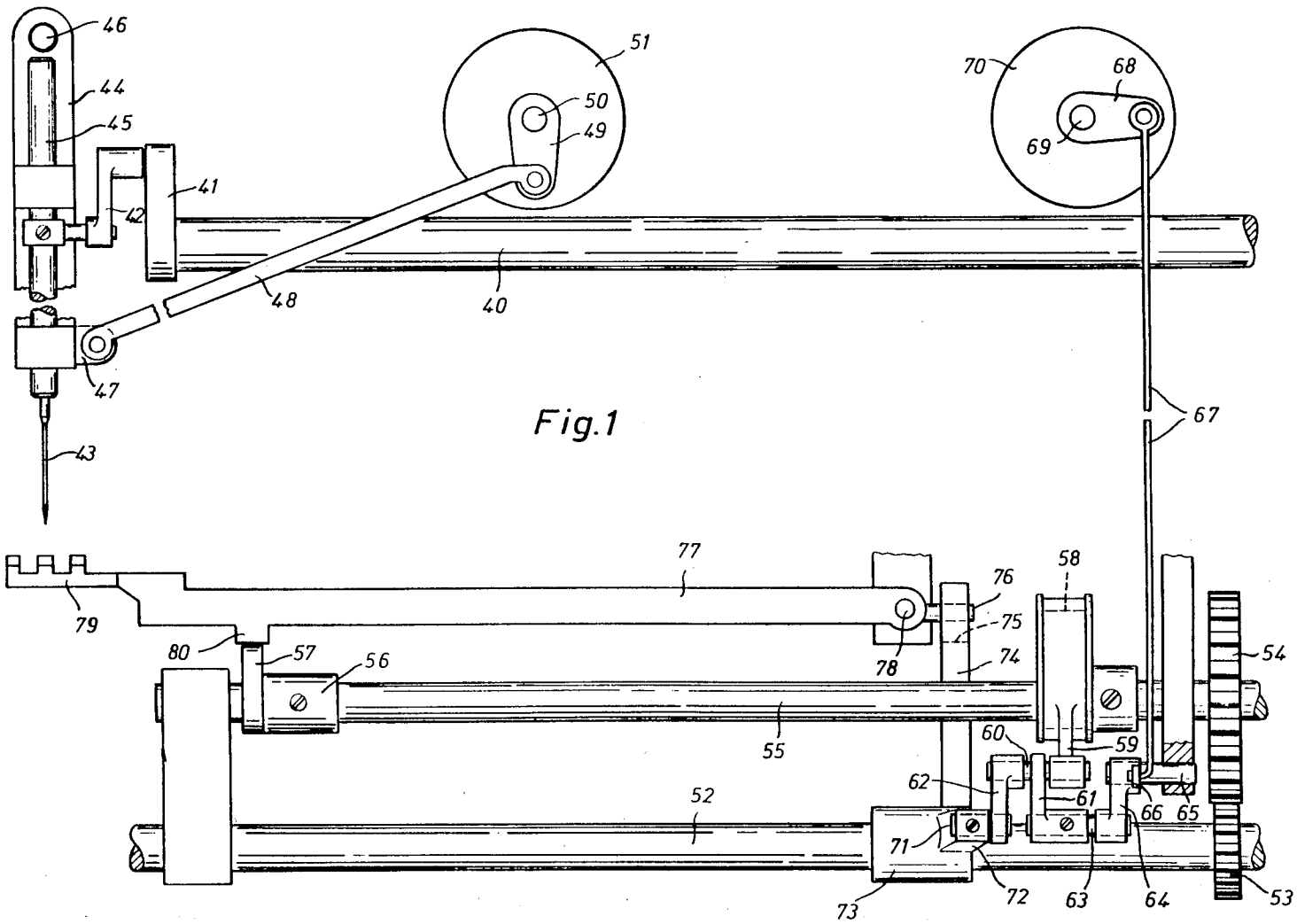
FIG. 1 is an elevational view of a zig zag sewing machine equipped with electronically controlled stepping motors, one for setting the bight of the needle bar, and the other for setting the step of the feed dog.

Referring to the drawings in particular the invention embodied therein comprises a method of making a sewn pattern arrangement which has a pattern length and a pattern width and which is produced by a zig zag sewing machine shown in FIG. 1 wherein the workpiece is positioned in the range of the pattern length and within the stitch width of the zig zag sewing machine. Individual patterns are sewn in accordance with the pattern arrangement and in accordance with the method of the invention by forming a plurality of stitches which have a width equal to a fraction of the stitch width and in which the respective final perforation within the range of a pattern length forms the starting perforation of a subsequent pattern in the next range of pattern length.

The manner of controlling stepping motors for setting the pivoting of the needle bar within the bight range, and the feed stop and direction of the feed dog of a zig zag sewing machine shown in FIG. 1 by means of a microcomputer is comprehensively described in German OS No. 29 42 844 to applicant. Therefore, it will be satisfactory for understanding the present invention to shortly describe the design of such a sewing machine.

The sewing machine comprises a main shaft 40 by which through a crank 41 and a link 42, a needle bar mounted on a swing arm 44 and carrying a needle 43 is reciprocated up and down. Swing arm 44 is supported in the housing of the sewing machine by means of a pin 46.

Swing arm 44 has an extension 47 which is connected through a link 48 to a crank 49 secured to the shaft 50 of a stepping motor 51 which is accommodated in the housing of the sewing machine and intended for controlling the bight or stitch width of needle 43.

Main shaft 40 drives a lower shaft 52 through a chain (not shown). Secured to shaft 52 is a gear 53 meshing with another gear 54 which is secured to a shaft 55 extending parallel to shaft 52. Shaft 55 carries a lifting eccentric 56 which is screwed thereto and designed with a cam 57. Further screwed to shaft 55 is an eccentric 58 embraced by an eccentric lever 59 to which two links 61, 62 are hinged by means of bolt 60. Link 61 is rotatably connected through a bolt 63 to a crank 64 which is mounted for rotation on a shaft 65 supported in the housing of the sewing machine and connected through an arm 66 of crank 64 and a rod 67 to a crank 68 which is secured to the shaft 69 of a second stepping motor 70 accommodated in the housing and controlling the work feed of the sewing machine.

Through a bolt 71, link 62 is hinged to an arm 72 of a swing lever 73 which is mounted on shaft 52. Another, upwardly extending arm 74 of swing lever 73 is provided with a guide slot at its end, in which a pin 76 is guided. Pin 76 is secured to a supporting arm 77 which is mounted for displacement of a horizontal shaft 78 supported in the machine housing and extending parallel to the feed direction. At its free end, supporting arm 77 carries a feed dog 79 for advancing the work to be sewed by needle 43 in cooperation with a rotary hook (not shown). Supporting arm 77 bears through a downwardly projecting extension 80 on cam 57 of lifting eccentric 56.

The two stepping motors 51 and 17 are substantially identical in design and in their controlling functions. Stepping motor 51 controls the lateral stitching or bight motion of the swing arm 44 relative to an initial position of needle 43, namely the position "B0" in bight position "L", see FIGS. 12–14, while stepping motor 70 controls the movements of feed dog 79 of the machine in the feed direction, arrow V.

As disclosed in the above cited German OS No. 29 42 844, stepping motors 51 and 70 are controlled by a microcomputer in which control instructions of a plurality of patterns to be recalled in any desired sequence are stored in coded form. Such stored patterns may, for example, be those shown in FIGS. 2 to 14.

Figure 12:
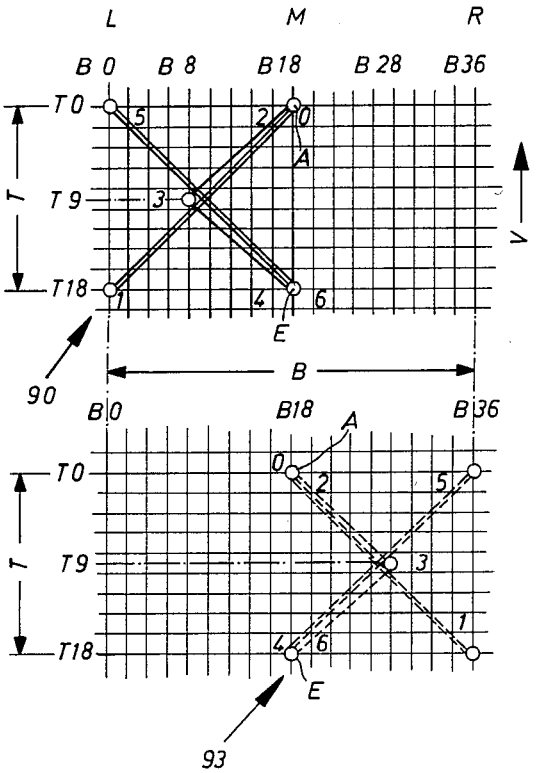
Figure 13:
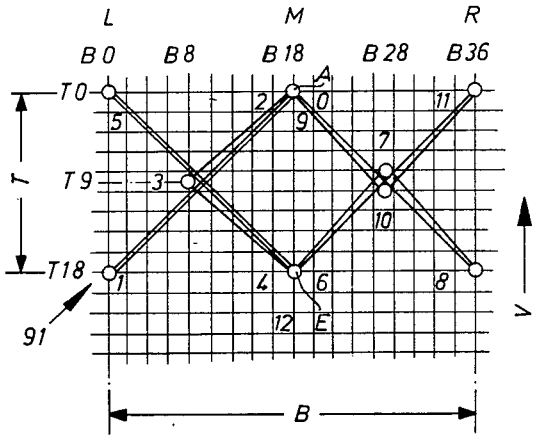

The maximum bight range B within which needle 43 can form a stitch, i.e. pierce the work, reaches in the present example from the initial position "B0" designated "L" (left) up to a position B 36, FIGS. 12 to 14, designed "R" (right). The maximum range T in the feed direction may be provided from T0 to T24, as indicated.

The points designated B0 to B36 and T0 to T24 indicate the bight positions of needle 43, and work positions, respectively, during the sewing of a pattern. These positions are listed in the shown tables, in FIGS. 12–14, for sewn patterns 90–93, with, in the individual positions of the work (stepping motor 70), the plus sign being used for movements in the feed direction arrow V and the minus sign for movements in the opposite direction.

Sewn patterns 90–93, FIGS. 2–4 or 12–14, are based on a bisection of bight range B, meaning that the elementary patterns 90, 92 and 93 extend at most over one-half of bight range B, while sewn patterns 94–105, FIGS. 5–11, are based on a trisection of bight range B, where the width of an elementary pattern 94–99, is equal at most to one-third bight range B. In general, these two divisions are satisfactory for the majority of embroidering work. Should sewing with larger bight ranges be available, further subdivisions might be provided for the arrangement of pattern elements and further combinations and thus variations of the pattern may be produced while combining the normal sequence of stitches with their reversal and correspondingly controlling the direction of sewing and position of the pattern elements within the bight range. Each pattern in a group which can be combined into a pattern combination (e.g. FIGS. 15 and 17) must thus have a width which is an integer fraction (i.e. 1/1, 1/2, 1/3 . . . ) of the maximum bight width. The patterns are all cross-stitch patterns in a rectangular area (including a square area) with legs or beams that extend from one or more cross points by equal amounts.

The electronic control of the sewing machine is so designed that the control instructions for stepping motors 51 and 70 of each elementary pattern to be sewed are stored in coded form in the permanent memory of the microcomputer and can therefore be transferred by their starting addresses and in the desired sequence into the program storage, to control stepping motors 51, 70 and sew the pattern. Since what varies from pattern to pattern and determines the arrangement is only the sequence of feed amount and direction, and the bight position of the needle, while the mode of producing a pattern element is identical for all of the pattern programs stored in the microcomputer, it will suffice to explain the sequence of stitches, and the corresponding positions of the needle and the work, for a single pattern stripe namely that composed of pattern rows M2 and M3 and elements 90, 93 and illustrated by FIGS. 2, 12 and 15.

From the permanent storage of the microcomputer, the starting addresses of the coded programs of pattern elements 93, 90 are selected and entered into the program storage, namely once the starting address of pattern 93, and consecutively thrice the starting address of pattern 90, wherefrom they are recalled as the program is performed, to set positions for producing the individual pattern elements in the predetermined sequence. During the sewing operation, in a known manner, recalling of a starting address causes the sequential calling of all the coded control data of the respective elementary pattern. The microcomputer controls through stepping motors 51 and 70 the lateral swinging movements of swing arm 44 and the feed movements of feed dog 79 in accordance with the program.

Figure 2:
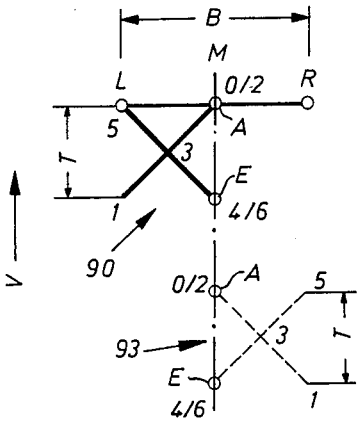
FIGS. 2 through 11 are examples of elementary cross-stitch patterns in symbolic representation, with their respective mirror-image element, if necessary, being shown in broken lines.
Figure 3:
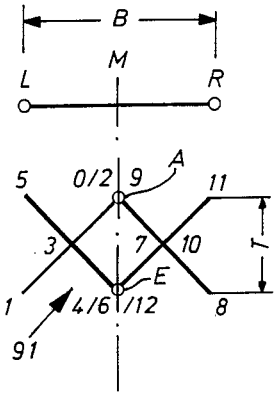
Figure 4:
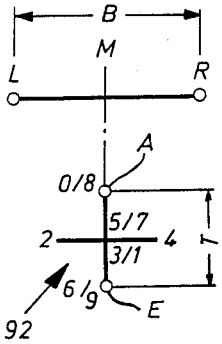
Figure 5:
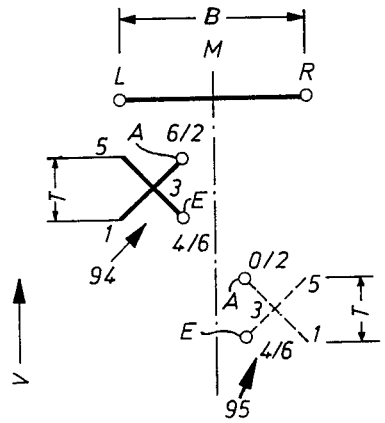
Figure 6:
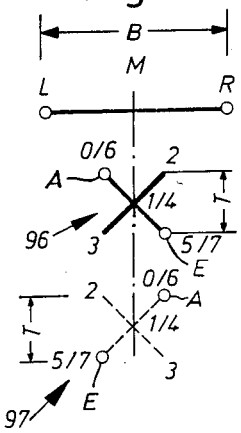
Figure 7:
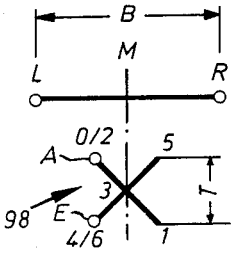
Figure 8:
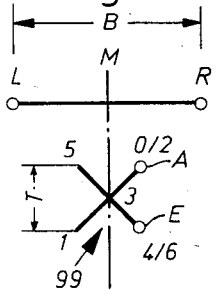
Figure 9:
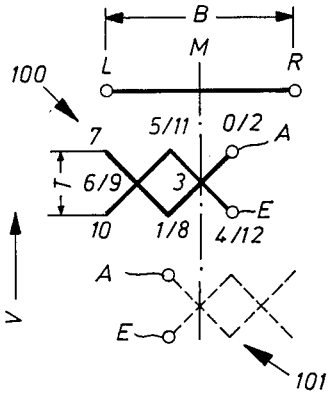
Figure 10:
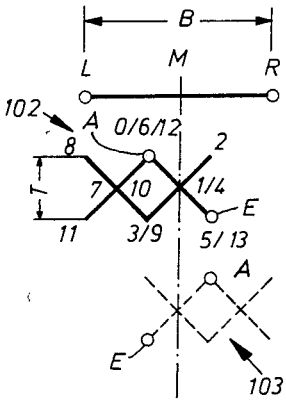
Figure 11:
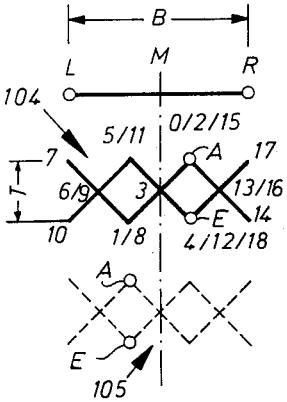

Pattern element 93, FIGS. 2 and 12, is sewed in a stitch sequence as indicated by perforations 0 to 6 and as listed correspondingly in the table. The sewing of the pattern element starts at A, in the feed position T0 and with needle 43 in its bight position B18 (or at piercing point). In this position of needle 43, swing arm 44 is pivoted by stepping motor 51 through crank 49 and link 48 out of its initial position B0, while stepping motor 70 stands still. The next piercing by needle 43 is effected at 1, i.e. in the feed position T18 and bight position B36. To reach or set these positions, stepping motor 70 turns in one direction and moves stitch guide 60–64 and thus feed dog 79 to advance the work in the direction of arrow V through a distance T, FIG. 12, while stepping motor 41 simultaneously brings swing arm 44 with needle 43 into position B36. As shaft 69 of stepping motor 70 is turned, crank 68, rod 67 and crank 64 displace bolt 63 whose longitudinal axis thereby becomes misaligned with the longitudinal axis of bolt 71, so that swing lever 73 is pivoted about shaft 52, and displaces, through arm 74 and pin 76 carried by supporting arm 77, feed dog 79 in the feed direction V. Lifting movements are imparted to the feed dog in the usual manner, through cam 57 of lifting eccentric 56, cooperating with extension 80 of arm 77.

To make the third stitch, namely pierce the work at 2, stepping motor 70 executes a controlling motion in the opposite direction and moves stitch guide 60 to 64 and feed dog 79 to displace the work by a distance T corresponding to the length of elementary pattern 93, in the direction opposite to the feed direction V, while stepping motor 51 causes pivoting of swing arm 44 and needle 43 into B18. After this stitch, stepping motor 70 moves stitch guide 60 to 64 again in the first direction of rotation so as to cause feed dog 79 to move the work from T18 to T9, while stepping motor 51 brings swing arm 44 with needle 45 into position B28, and the work is pierced at 3, to form the next stitch. In the same way, the stitches at 4, 5 and 6 are made to complete the sewing of pattern element 93, with the last stitch being formed at 6, i.e. at point E.

A similar manner of stitching as in pattern 93 is provided in other elementary cross-stitch patterns, such as 90 to 105, namely the sequence of stitches is chosen so as to cover each diagonal line with at least one continuous length of thread, without an intermediate stitch, to obtain a satisfactory aspect of the cross pattern.

At the location where the final stitch E of preceding element of the pattern 93 was made, the first stitch E of the next programmed pattern element 90 is formed. This starting stitch at A of a next pattern element, however, may be omitted at every next pattern by writing a corresponding program, since while selecting and programming the patterns for combining a plurality of different patterns to a row, such as M1 to M6, FIGS. 15–18, care must be taken to have the respective final stitch of a pattern coincident with the starting stitch of the next pattern, thus to avoid jump stitches which do not belong to the pattern.

Now, the programmed sequential sewing of the three pattern elements 90 following the single element 93 have been completed, with the individual needle positions being controlled by stepping motors 51 and 70, in the way as explained by connection with elementary cross-stitch pattern 93. Upon forming the last stitch E of the third elementary cross-stitch pattern 90, the program sequence of a pattern 93 with free following patterns 90 is repeated as many times as necessary for completing the desired length of a pattern row M2 formed of these elementary patterns. Thereupon the starting addresses of the program of patterns 90 and 93 are retransferred from the program storage to the permanent storage of the microcomputer, and the same starting addresses are recalled into the program storage in a different order corresponding to pattern row M3 which will follow row M2, namely in the sequence of pattern 90 once, and 93 consecutively thrice. The work is then displaced by a width corresponding to bight range B, transversely to the feed direction V. Care must be taken in this shift, to start the sewing of pattern row M3 at the same level as row M2 has started. The individual elementary cross-stitch patterns 90 and 93 are then sewed in the programmed sequence and repetition, under the control of the needle and the work by stepping motors 51 and 70 to form pattern row M3. FIG. 16 shows the resulting combination of pattern rows M2 and M3 to a border pattern. Further pattern rows M1 are added at either side of the combination, which are sewn as a series of elementary cross-stitch patterns 91.

It further follows from FIG. 16 that larger spacing between combined pattern rows may be bridged by connecting rows formed of elementary pattern 92. For this purpose, the work is inserted into the machine in a position turned through 45° relative to the pattern rows M1 to M3. This brings the thread legs of this pattern into the correct position and alignment within the embroidery.

While pattern rows M1 to M3 of the border design shown in FIG. 16 are formed of pattern elements based on a bisection of the bight width B, border pattern rows M4 to M6, FIGS. 17 and 18, are formed of pattern elements based on a trisection of the same width B. As follows from FIG. 17, the sewing of pattern row M5 must be programmed as a sequence of elements 94,96,95,95,104,95 97,94,105. To sew pattern row M6, the sequence to be programmed is 95,97,94,94,105,94,96,95,104. The selection must be such as to always obtain the final perforation of one pattern coincident with the starting perforation of the following pattern. Any fancy combination of pattern elements in a row may thus be provided in parallel arrangement to form an impressive large-sized pattern.

While specific embodiments of the invention have been shown and described in detail to illustrate the application of the principles of the invention, it will be understood that the invention may be embodied otherwise without departing from such principles.

What is claimed is:

1. A method of stitching a combined pattern from a group of patterns wherein each pattern in the combined pattern is connected directly to an adjacent pattern without jump stitches between patterns, and using a zig zag sewing machine having a needle mounted to execute lateral bight movement within a maximum bight width and a feed member mounted to execute longitudinal feed motion, comprising:

selecting a plurality of patterns for the group of patterns which each lie in a rectangular area and include a plurality of stitches which form at least one cross-stitch having a cross point with legs extending by equal amounts from the cross point, stitches in each pattern forming said cross stitch lying at 90° with respect to each other and the width of said rectangular area for each pattern being an integer fraction of the maximum bight width, each pattern having a starting and a final needle perforation point which are spaced apart in the longitudinal direction by a longitudinal width of the rectangular area, a starting point of at least some patterns in the group of patterns corresponding to a final point of at least some patterns in the group of patterns;

establishing a sequence of permissible patterns for the combined pattern wherein each pattern in the sequence has a final point corresponding to a starting point of a preceding pattern in the sequence; and stitching the combined pattern using a plurality of the patterns within the group of patterns and observing the established sequence, the combined pattern being stitched to include some patterns which are staggered with respect to each other in the longitudinal direction and at least some patterns which are parallel to each other in the longitudinal direction.

2. A method according to claim 1, including forming each pattern in the group of patterns with a final stitch extending over said cross point and terminating at the final needle perforation point for that pattern.

3. A method according to claim 1, including selecting the plurality of patterns so that at least some patterns in the group of patterns are mirror images of other patterns in the group of patterns.

4. A method according to claim 1, wherein each leg of each pattern in the group of patterns extends diagonally at 45° to said longitudinal direction and to said lateral direction.

5. A product of manufacture comprising a workpiece which can be sewn by a zig zag sewing machine, and a combined pattern of stitches defined on said workpiece which includes a plurality of individual patterns connected to each other in sequence in a workpiece feed direction over said workpiece, each individual pattern having a width corresponding to an integer fraction of a maximum bight width lying transversely to the feed direction, each individual pattern confined in a rectangular area and including at least one cross-stitch having a center point and including legs extending by equal amounts from said center point and arranged to cross each other at 90°, each individual pattern having a starting point and a final point with a final point of each individual pattern corresponding to a starting point of a subsequent individual pattern in said sequence, some of said individual patterns being staggered with respect to each other in the longitudinal direction and at least some of said individual patterns being parallel to each other in the longitudinal direction.

6. A product of manufacture according to claim 5, wherein all of said legs of each individual pattern extend at 45° to said longitudinal direction, each individual pattern having a starting point which is spaced from its final point by a distance equal to a width of said rectangular area in said longitudinal direction.

7. A product of manufacture according to claim 5, wherein each leg of each individual pattern extends at 45° to said longitudinal direction, each individual pattern having a final stitch extending over said cross point and terminating at said final point.

8. A product of manufacture according to claim 5, wherein said plurality of individual patterns includes a first set of individual patterns which are in mirror images of a second set of individual patterns.

9. A product of manufacture comprising a workpiece which can be sewn by a zig zag sewing machine, and a combined pattern of stitches defined on said workpiece which includes a plurality of individual patterns connected to each other in sequence in a workpiece feed direction over said workpiece, each individual pattern having a width corresponding to an integer fraction of a maximum bight width lying transversely to the feed direction, each individual pattern confined in a rectangular area and including at least one cross-stitch having a center point and including legs extending by equal amounts from said center point and arranged to cross each other at 90°, each individual pattern having a starting point and a final point with a final point of each individual pattern corresponding to a starting point of a subsequent individual pattern in said sequence, at least one of said individual patterns being confined in a square containing a single criss-cross pattern and having a starting point at one corner of said square and a final point at a second corner of said square which is spaced from said starting point in the longitudinal direction, each individual pattern being confined in a square area having a width of one-half the maximum bight width, one edge of the square area of each individual pattern lying on a center line of said combined pattern of stitches in said longitudinal direction.

10. A product of manufacture according to claim 9, wherein said plurality of individual patterns includes at least some patterns lying on one side of said center line with respect to said transverse direction and at least some individual patterns lying on an opposite side of said center line.

11. A product of manufacture according to claim 9, wherein said criss-cross stitch of each individual pattern has a width of one-third the maximum bight width, at least some of said plurality of individual patterns formed by a single cross-stitch in a square area.

12. A product of manufacture according to claim 11, wherein at least some individual patterns in said plurality of individual patterns are formed of three criss-cross stitches lying side-by-side in the transverse direction.

13. A product of manufacture according to claim 12, including at least some individual stitches which are made of a single cross-stitch lying on one side of said bight width, at least some lying in a middle of said bight width and at least some lying on an opposite side of said bight width.

* * * * *